US007958821B2

(12) United States Patent
Kümmet et al.

(10) Patent No.: US 7,958,821 B2
(45) Date of Patent: Jun. 14, 2011

(54) PRINTING UNIT OF A PRINTING MACHINE, A METHOD FOR USE THEREOF AND A PRINTING MACHINE WITH A PLURALITY OF MODULES

(75) Inventors: Andreas Kümmet, Zell am Main (DE); Werner Ludwig Fischer, Rimpar (DE); Uwe Alexander Reuter, Margetshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 3 days.

(21) Appl. No.: 12/736,120

(22) PCT Filed: Mar. 11, 2009

(86) PCT No.: PCT/EP2009/052844

§ 371 (c)(1),
(2), (4) Date: Sep. 10, 2010

(87) PCT Pub. No.: WO2009/112514

PCT Pub. Date: Sep. 17, 2009

(65) Prior Publication Data

US 2011/0000383 A1 Jan. 6, 2011

(30) Foreign Application Priority Data

Mar. 14, 2008 (DE) ..... 10 2008 000 682
Mar. 14, 2008 (DE) ..... 10 2008 064 625

(51) Int. Cl.
*B41F 5/00* (2006.01)

(52) U.S. Cl. ..... 101/216; 101/217; 101/350.1; 101/365; 101/480; 101/219

(58) Field of Classification Search ..... 101/216, 101/142, 217, 250.1, 365, 480, 219
See application file for complete search history.

(56) References Cited

U.S. PATENT DOCUMENTS 5,156,638 A 10/1992 Wirz
5,784,957 A * 7/1998 Rau et al. ..... 101/142
5,784,964 A 7/1998 Rodi
(Continued)

FOREIGN PATENT DOCUMENTS

DE 9116208.4 U1 5/1992
(Continued)

*Primary Examiner* — Judy Nguyen
*Assistant Examiner* — Matthew G Marini
(74) *Attorney, Agent, or Firm* — Jones, Tullar & Cooper, P.C.

(57) ABSTRACT

A printing unit of a printing machine is supported by a pair of spaced side frames that are disposed opposite to each other. The printing unit includes at least one printing machine and at least one ink unit. The printing machine is formed by a plurality of printing cylinders. Each of the spaced side frames include a longitudinal crossbar that runs in the direction of transfer of a print substrate traveling through the printing unit. The two longitudinal crossbars form the boundaries of a foot space of the printing unit at two parallel sides. A plurality of pipelines are disposed in the foot space between the two longitudinal crossbars. These pipelines supply flowable media to the printing unit, which flowable media can be either liquid or gaseous. At least one of the pipelines is connected to a user of one of the supplied flowable media in the printing unit or to at least one source of the flowable media. The printing machine can utilize a plurality of printing units.

15 Claims, 6 Drawing Sheets

U.S. PATENT DOCUMENTS

| | | | |
|---|---|---|---|
| 2001/0017088 | A1 | 8/2001 | Dilling et al. |
| 2005/0247017 | A1 | 11/2005 | Compagnone et al. |
| 2008/0022877 | A1 | 1/2008 | Gail et al. |

FOREIGN PATENT DOCUMENTS

| | | | |
|---|---|---|---|
| DE | 19513537 | A1 | 10/1996 |
| DE | 19830052 | A1 | 1/2000 |
| DE | 20012101 | U1 | 12/2000 |
| DE | 10008210 | B4 | 8/2001 |
| DE | 10008212 | A1 | 8/2001 |
| DE | 10008212 | B4 | 8/2001 |
| EP | 1285753 | B1 | 2/2003 |
| EP | 1616697 | A2 | 1/2006 |
| EP | 1616697 | A3 | 1/2006 |
| EP | 1616697 | A8 | 1/2006 |
| EP | 1882586 | A2 | 1/2008 |
| EP | 1882586 | A3 | 1/2008 |
| GB | 2253373 | A | 9/1992 |

* cited by examiner

PRINTING UNIT OF A PRINTING MACHINE, A METHOD FOR USE THEREOF AND A PRINTING MACHINE WITH A PLURALITY OF MODULES

CROSS-REFERENCE TO RELATED APPLICATIONS

This application is the U.S. national phase, under 35 U.S.C. 371, of PCT/EP2009/052844, filed Mar. 11, 2009; published as WO 2009/112514 A1 on Sep. 17, 2009, and claiming priority to DE 10 2008 000 682.3, filed Mar. 14, 2008, and to DE 10 2008 064625.3, also filed Mar. 14, 2008, the disclosures of which are expressly incorporated herein by reference.

FIELD OF THE INVENTION

The present invention is directed to a printing unit of a printing press, to a method for use of a printing unit and to a printing press with a plurality of modules arranged adjoining one another in a row in the direction of transport of a print substrate that can be fed through said printing press. The printing unit has at least one printing couple, with a plurality of printing couple cylinders and at least one inking unit. The at least one printing couple is arranged between spaced side frames which each have a longitudinal crossbar oriented in a direction of transport of a print substrate through the printing unit. These longitudinal crossbars define a base area of the printing unit on two parallel sides.

BACKGROUND OF THE INVENTION

DE 100 08 212 B4 describes a fluid box for a printing couple of a printing press, which fluid box contains all of the control lines, along with hose and/or pipe connections for supplying the functional elements of the printing couple. The supply lines are equipped with interfaces with which the fluid box can be coupled to at least one additional fluid box of an adjoining printing couple. The fluid box has a modular body which is embodied as a passable platform, and which can be connected, through the use of interfaces, to the printing couple and/or to an electric or electronic switchgear cabinet. The hose and/or pipe connections for use in supplying the functional elements of the printing couple are therefore located outside of the structural space of the printing couple. The result is that multiple lines are to be introduced, through the use of interfaces, into the relevant printing couple, for example, resulting in substantial assembly costs at the location where the printing press is set up. Additionally, the fluid box disclosed in DE 100 08 212 B4, if it is embodied as an independent module, separate from the printing couple, must also usually be delivered separately from the printing couple to the assembly site of the printing press, thus resulting in additional logistical expense.

A printing press coupling system for use in coupling supply lines to a printing press module, and especially to an inking unit or to a dampening unit of a printing press, is disclosed in EP 1 882 586 A2. A coupling element on the side of the printing press module and a coupling element on the side of the supply line are provided in this system. The coupling element on the printing press module side and the coupling element on the supply line side comprise all of the interfaces for the central coupling of all fluid supply lines and/or all electrical supply lines, so that all fluid supply lines and/or all electrical supply lines can be connected together to the printing press module.

A printing press having multiple machine units arranged one in front of the other in the direction of transport of a print substrate is disclosed in US 2005/0247017 A1. Adjoining machine units are aligned with one another.

SUMMARY OF THE INVENTION

The object of the present invention is to devise a printing unit for a printing press which will facilitate the work which is involved in the setting up and the starting up a printing press that is comprised of a plurality of modules, and particularly that is comprised of a plurality of printing units.

The object of the present invention is attained, according to the present invention by the provision of at least one printing unit of a printing press and having at least one printing couple. That printing couple includes a plurality of printing couple cylinders and at least one inking unit. The at least one printing unit is arranged between a pair of spaced side frames each of which has a longitudinal crossbar extending in a direction of transport of a print substrate which is to be fed through the at least one printing unit. The two longitudinal crossbars define a base area of the printing unit on two sides of the printing unit. A plurality of pipelines are arranged in the base area and serve to supply media to the printing unit, which media may be either a liquid or a gas. At least one of the pipelines is connected to at least one consumer of the media and which is located in the printing unit and which is to be supplied with the respective medium, or is connected to at least one source of supply of the respective medium. A plurality of modules, which are arranged in a row in the print substrate transport direction, can each have such a structure of side frames with longitudinal crossbars. The longitudinal crossbars of each module are arranged in a row and define a continuous base area in the printing press. The pipelines can be fully coupled to their respective consumers or sources of media arranged in the respective printing unit before that printing unit is transported to a location where the printing press will be used.

The benefits to be achieved, in accordance with the present invention, consist especially in that the time which is required for setting up and starting up a printing press that is comprised of a plurality of modules, and particularly with each module being embodied as a printing unit, is reduced. This is accomplished by decreasing the amount of assembly work which is required at the setup site, typically at the location where this printing press will be used. The decreased assembly work is a result of, for one thing, the fact that modules, such as, for example, the printing units, which are to be installed in a row, can be joined to one another, and can be more easily aligned with one another by the use of fixed stops which are provided on the assigned side frames and which are usable for producing an alignment oriented in the direction of transport of a print substrate to be printed in these printing units, for example, or at least which is fed through these modules. A particular benefit of the subject invention is that pipelines, that serve to supply media, are not coupled with their respective consumers or sources of such media, and which are arranged in the relevant printing unit, at the location where the printing press will be used. Instead, such pipelines are coupled during the manufacture of the relevant printing unit, and thus before such a printing unit is delivered to a customer. Additionally, more uniform lengths can be realized for the pipelines which are located in the base area of the printing unit. This is especially advantageous when compressed air will be supplied to consumers of the compressed air, as this allows any delay in reaction between consumers, which may be arranged on different sides of the printing unit, to be minimized.

The solution in accordance with the present invention results in a saving of costly assembly time at the setup location of the printing press. It also allows the delivery requirement of individual parts belonging to the printing press, and thus the associated logistical expense, to be decreased. Transport costs can also be reduced since the pipelines are not transported separately, but preferably are transported as a component of the respective module and thus can be transported, together with this module, on the same transport to the location where the printing press will be used. It is also advantageous that a printing unit, which is embodied in accordance with the present invention, is relatively compact in its dimensions, and therefore no extra-wide transport assemblies, such as specially designed trucks, for example, which would increase transport costs, are required for its transport.

BRIEF DESCRIPTION OF THE DRAWINGS

A preferred embodiment of the present invention is represented in the set of drawings and will be specified in greater detail in what follows.

The drawings show.

DESCRIPTION OF THE PREFERRED EMBODIMENT

Figure 1:
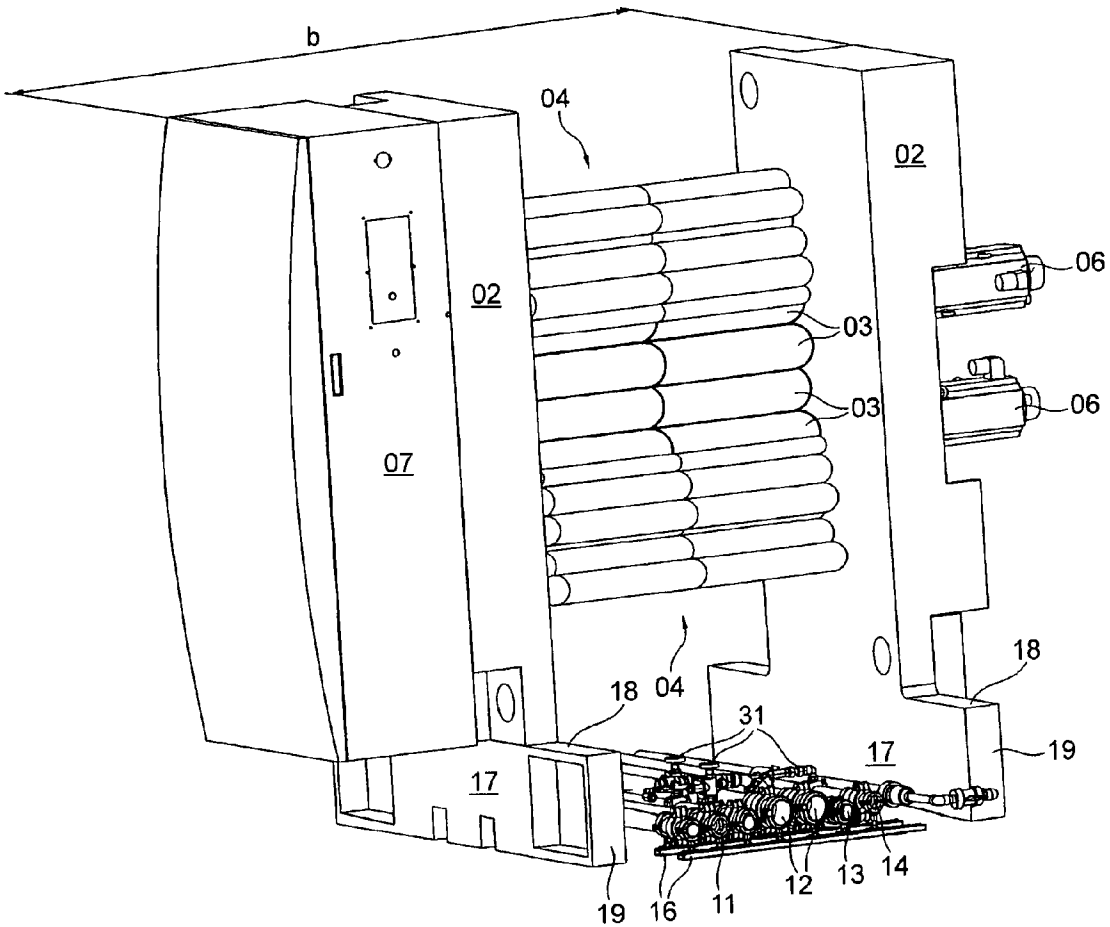
FIG. 1 a schematic perspective view of a printing unit of a printing press in accordance with the present invention.

A printing press, which preferably is a rotary printing press, and in particular is a commercial printing press, has a plurality of machine units, some of which are identical. These machine units are also referred to as modules of the printing press. One such module, which may be embodied, by way of example as a printing unit 01, is shown in simplified form in both FIG. 1 and FIG. 2, each in a perspective representation. A print substrate 24, such as, for example, a web of material 24, and particularly a paper web 24, is fed, or at least can be fed, essentially horizontally through the shown printing unit 01, as may be seen in FIG. 3, and preferably can be fed through additional printing units 01 which are arranged in a row in the direction of transport of the print substrate 24, and which additional printing units 01 are embodied as being essentially identical, in structure, to the printing unit 01 shown. In order to form a printing press that is capable of producing printed products, a plurality of modules belonging to this printing press are assembled, particularly in a row, in a print shop, for example. Each of such a plurality of modules is preferably-embodied as a printing unit 01. Additional modules belonging to this printing press, which are also to be added, at least in part, to a printing unit 01, can be embodied, for example, as a reel changer, an infeed unit, a varnishing unit, a dryer or a folder. These modules are produced and installed and their respective functionality is tested especially by the manufacturer of the printing press, preferably each as a separate functional component, and typically before being delivered to a customer.

Figure 2:
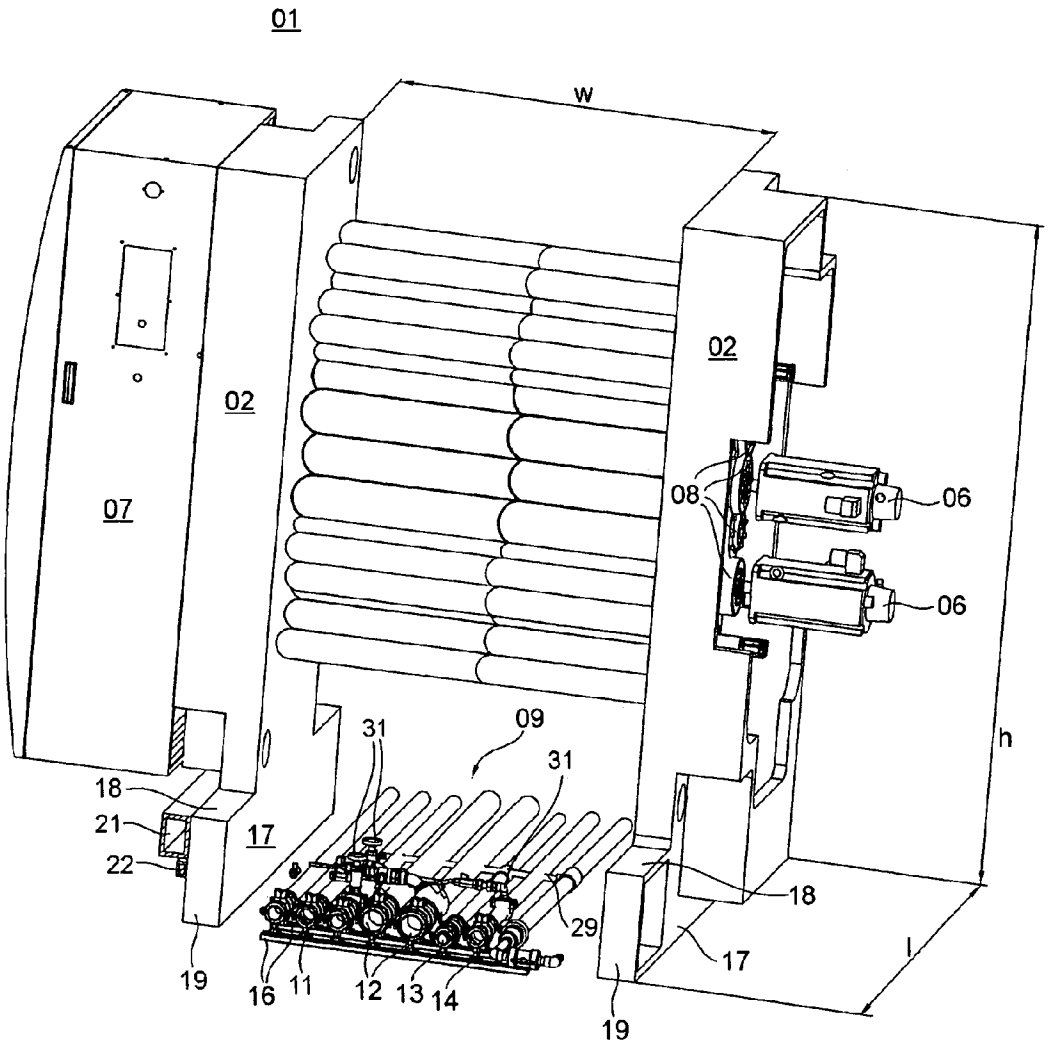
FIG. 2 another schematic perspective view of the printing unit of FIG. 1 and taken from a different perspective.
Figure 3:
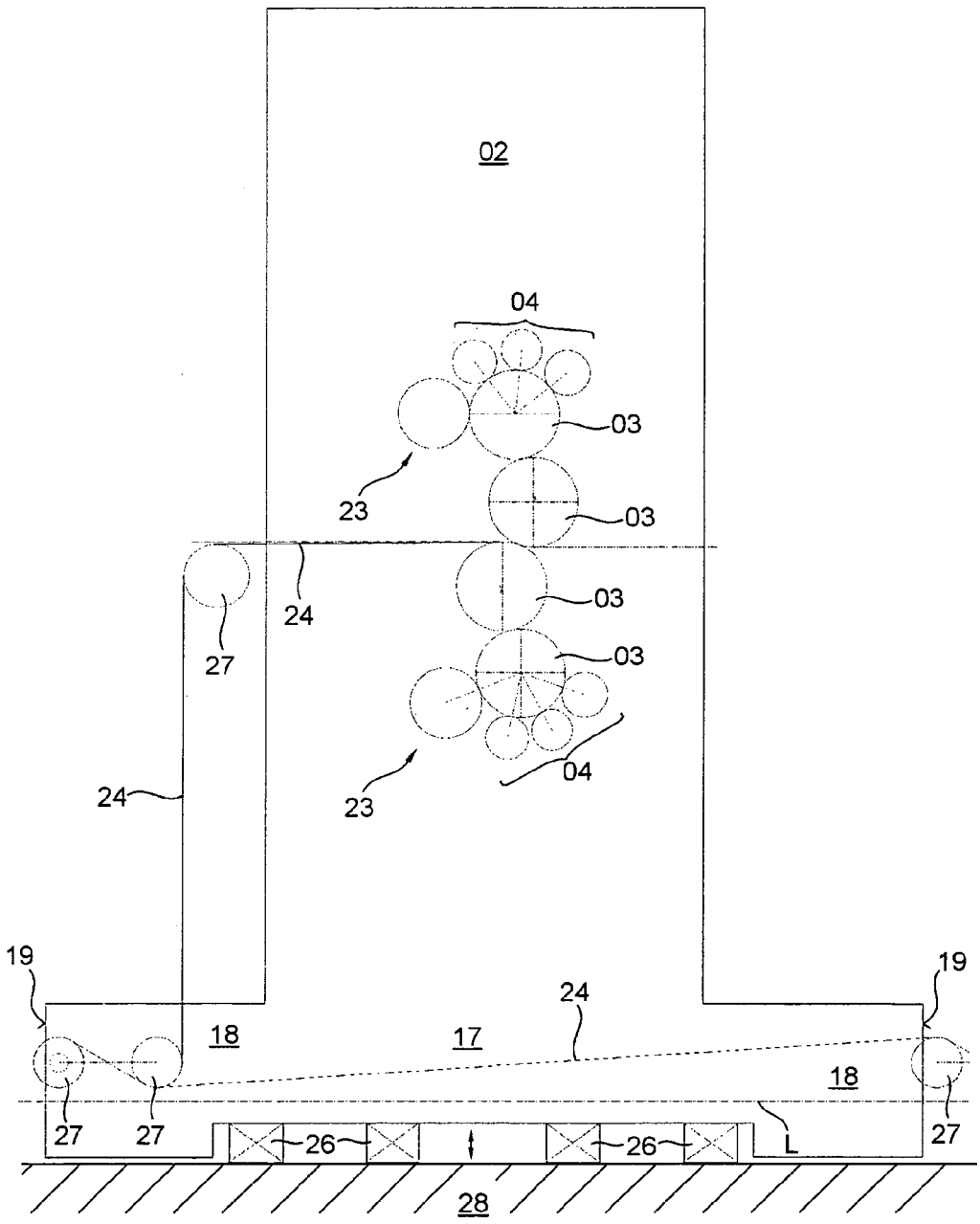
FIG. 3 a highly simplified schematic side elevation representation of an arrangement of printing couple cylinders and forme rollers in the printing unit of FIG. 1 or FIG. 2.

Preferably, each of these printing units 01, as shown by way of example in FIG. 1 and FIG. 2, has a pair of individually produced side frames 02, which are arranged spaced opposite one another, and between which a plurality of printing couple cylinders 03, at least one inking unit 04, which is comprised of a plurality of rollers, and, if applicable, at least one dampening unit 23 are arranged, as may also be seen in FIG. 3. If the printing press operates in an offset printing process, the printing couple cylinders 03 are embodied as at least one transfer cylinder with at least one forme cylinder assigned to it. The transfer cylinder of one printing couple rolls against an impression cylinder, which is, in turn, embodied, for example, as a transfer cylinder of another printing couple, and which second transfer cylinder also cooperates with an additional forme cylinder to enable simultaneous, two-sided printing of the print substrate 24. The print substrate 24 is fed through a press nip that is formed by the two transfer cylinders which are rolling against one another, all as may be seen in FIG. 3. In the example shown in FIG. 1 through FIG. 3, four printing couple cylinders 03, forming two pairs of printing couple cylinders, with each pair being comprised of a transfer cylinder and a forme cylinder. The transfer cylinders of the respective two pairs of printing couple cylinders are offset relative to one another at an acute angle from vertical. The two pairs are nevertheless arranged essentially vertically one above the other in the printing unit 01. An inking unit 04, which is comprised of a plurality of rollers and, if applicable, a dampening unit 23 are engaged against each of the two forme cylinders. The inking unit 04 and the optional dampening unit 23 are indicated schematically in FIG. 3 only by their respective forme rollers being shown as being engaged against the respective forme cylinders. On the outer surface of the forme cylinder or on the outer surface of each forme cylinder, at least one printing forme is arranged, or at least can be arranged. If the printing press is embodied as a commercial printing press, a single printing forme, which spans the circumference of the relevant forme cylinder, is typically positioned on each forme cylinder. Each of the transfer cylinders is covered, or at least can be covered, on its outer surface, with at least one printing blanket, such as, for example, a rubber blanket, and preferably a metal based blanket with a rubber outer layer which engages the associated printing forme on the forme cylinder.

Each of the printing couple cylinders 03 can be driven by at least one drive 06 which is typically arranged on one of the side frames 02. This drive 06 is depicted in FIG. 1 and FIG. 2 as being arranged outside of the printing couple which is formed by the printing couple cylinders 03 and the at least one inking unit 04. Preferably, a drive 06 is assigned to the pair, that is comprised of a transfer cylinder and a forme cylinder that cooperates with it, which pair is the lower pair, in relation to the print substrate 24 that can be fed horizontally through the press nip of the printing unit 01. Such a drive 06 transfers its drive torque to a respective rotational axis of the transfer cylinder and forme cylinder by the use of a transmission 08. The drive 06 preferably acts directly on the rotational axis of the forme cylinder, thereby driving the assigned transfer cylinder. The same applies to the transfer cylinder and forme cylinder pair that is the upper pair in relation to the print substrate 24 that can be fed horizontally through the press nip of the printing unit 01. Each of the drives 06 is preferably embodied as an electric motor 06, for example, and preferably as such an electric motor 06 that is controllable in terms of its speed of rotation and its angular position. The control of the angular position of the motor 06 refers to a rotational angle position relative to at least one printing couple cylinder 03 which is being driven by a different drive 06.

On the side frame 02 which is opposite to the side frame 02 that carries the drives 06, and also outside of the structural space which is occupied by the printing couple that is formed by the printing couple cylinders 03 and by the at least one inking unit 04 and, if applicable, also by a dampening unit 23, an electrical switchgear cabinet 07 is also preferably arranged. This switchgear cabinet 07 is preferably mounted directly on the relevant side frame 02. Electric devices for use in controlling and/or regulating the operation of this printing unit 01 are housed in this electrical switchgear cabinet 07. At least one electric drive controller is preferably also housed in this electrical switchgear cabinet 07. It controls the drive 06 or the drives 06 which are provided for the printing couple cylinders 03. If each of the two drives 06 which are arranged in the same printing unit 01 is controlled separately from the other drive 06 by its own separate drive controller, then these two drive controllers are usually smaller in structure than would be in the case of a shared drive controller for the two drives 06. In most cases, two smaller drive controllers also generate comparatively less exhaust heat. Therefore, the two separate, smaller drive controllers can be more easily integrated into the same electrical switchgear cabinet 07. Additionally, separate drives 06 for the upper and lower printing couples of the same printing unit 01 enable a simultaneous, such as, for example, synchronous change of at least one printing forme on each of the two forme cylinders of the printing unit 01. This is accomplishable especially because the respective angular positions of the two forme cylinders can be adjusted separately from one another.

Between the opposite side frames 02, and extending generally transversely to the direction of transport of a print substrate 24 that can be fed through this printing unit 01, suitable transverse crossbars are positioned. These transverse crossbars are not shown in FIG. 1 and FIG. 2 for purposes of clarity. Such transverse crossbars hold the two cooperating side frames 02 spaced from one another at a specific distance and structurally stabilize the relevant printing unit 01. Mounting points for two such transverse crossbars, for example, are indicated in FIG. 1 and FIG. 2 by circular elements. The height "h" of the printing unit 01 is between 2,500 mm and 3,000 mm, for example, and preferably is about 2,700 mm, and its width "b", extending transversely to the direction of transport of the print substrate 24, is between 2,000 mm and 3,000 mm, and preferably is about 2,500 mm, and its length "l", extending in the direction of transport of the print substrate 24, is between 1,500 mm and 3,500 mm, and preferably is about 2,000 mm. An inside width "w" between the two opposite side frames 02, as seen in FIG. 2, is from 1,000 mm to 1,800 mm, for example, and particularly is from 1,200 mm to 1,300 mm. A printing unit 01 of this type has a mass of between 4 and 8 metric tons, and preferably has a mass of about 6 metric tons or over 13,000 pounds.

Figure 4:
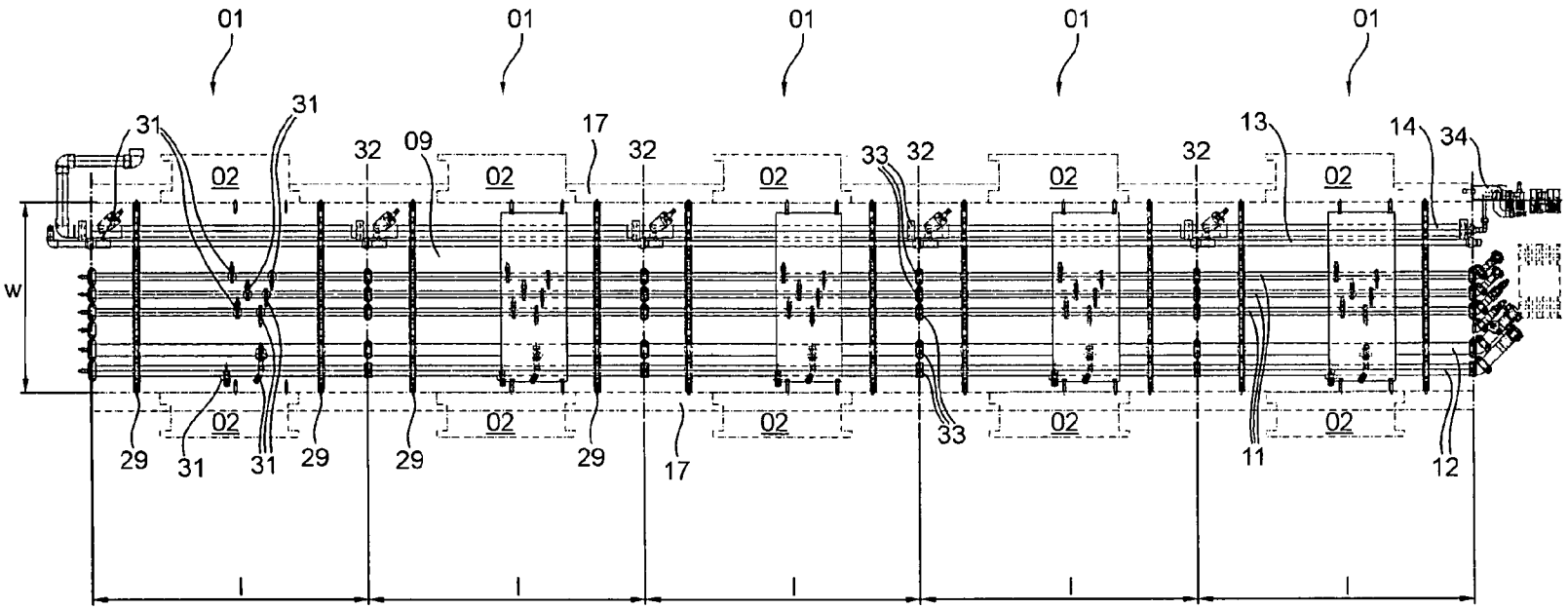
FIG. 4 a depiction of pipelines of a printing press in a top plan view and having, for example, a plurality of printing units according to FIG. 1 through FIG. 3.

In a base area 09 of the printing unit 01, which base area 09 is located below the printing couples of the printing unit 01, and between the opposite side frames 02, a plurality of pipelines 11; 12; 13; 14 are emplaced or positioned. Those pipelines 11; 12; 13; 14 each have a pipe length corresponding to the length "l" of this printing unit 01, with that length extending in the direction of transport of the print substrate 24 and with the plurality of pipelines 11; 12; 13; 14 being parallel to one another. These pipelines 11; 12; 13; 14, which are preferably arranged side by side, and which are spaced transversely from each other and transversely to the direction of transport of the print substrate 24 that can be fed through the printing press, serve to supply media to this printing unit 01. The respective medium supplied by each such pipeline is embodied as being flowable and is either liquid or gaseous. In particular, pipelines 11, may be used, for example, for transporting a coolant, such as water, for use in cooling heat exchangers that may be housed in the electrical switchgear cabinet 07. Pipelines 12 may be used, for example, for transporting a coolant, such as water, for use in controlling the temperature of rollers of the at least one inking unit 04 in this printing unit 01. Also provided in the group of these pipelines are pipelines 13, for example, for use in possibly supplying compressed air to the at least one printing couple in this printing unit 01. If applicable, pipelines 14, for example, can also be provided for accomplishing the return flow of a dampening agent which has been used in the printing couple. Optionally, pipelines for the supply and, if applicable, also for the removal of fluid may be added, for example, for use by a rubber blanket washing apparatus or by an image corrector. Each of the respective pipelines 11; 12; 13; 14 is preferably equipped at each of its respective ends, for example, with a coupling 33, as may be seen in FIG. 4, and preferably equipped with a quick-release coupling 33. This will allow these pipelines 11; 12; 13; 14 of several printing unit modules 01 to be rapidly assembled in line. This will be particularly advantageous if a plurality of these printing units 01, each equipped with such pipelines 11; 12; 13; 14, are to be assembled in a row. At least one of these pipelines 11; 12 13; 14, and preferably all of these pipelines 11; 12; 13; 14, are each connected through the use of at least one branch line, which is not shown here, and which may optionally have a shut-off valve 31, as seen in FIG. 4, to at least one media consumer which is disposed in this printing unit 01, and which media consumer may be, for example, a cooling device or a temperature controlling device, or to at least one media source, such as, for example, a dampening agent source. All of the aforementioned pipelines 11; 12; 13; 14 are preassembled at the plant where the printing unit 01 is manufactured, and are fully coupled to their respective media consumers or media sources, which are located in the printing unit 01 also during the manufacture of the printing unit or module 01. A pipeline that is usable for supplying the inking unit 04 with ink preferably does not run in connection with the pipelines 11; 12; 13; 14 arranged in the base area 09 of the printing unit 01. Such an ink unit supply pipeline is instead typically routed above the printing unit 01, for example, thereby facilitating accessibility to this ink supply line.

The pipelines 11; 12; 13; 14 of each printing unit 01 can be secured and fixed in their respective positions by the manufacturer during assembly of the printing unit 01. This can be accomplished by the provision and use of one or more transport securing devices 16 which extend across the width "b" of this printing unit 01. When the printing unit 01 is being set up in a print shop, these transport securing devices 16 can preferably be removed before the startup of production which is to be run on the resultant, assembled printing press. The transport securing devices 16 preferably also connect the assembly of pipelines 11; 12; 13; 14 to the two opposite side frames 02. The pipelines 11; 12; 13; 14 of each printing unit 01 extend parallel with longitudinal crossbars 17, which are embodied on the side frames 02, and which longitudinal crossbars 17 are preferably formed integrally with the side frames 02 in a seamless fashion. In the assembled printing press depicted in FIG. 4, and which is comprised of a plurality of the modules 01 which are arranged in a row, the pipelines 11; 12; 13; 14 extend through the continuous base area 09 of this printing press, preferably in a straight line, and from one end of this printing press to the other, all as is depicted schematically in FIG. 4.

On one transverse crossbar, which extends transversely to the direction of transport of the print substrate 24, for example, a control device, which is not specifically shown in the drawings, is arranged, which control device distributes compressed air to pneumatic consumers, such as operating cylinders, which are arranged in the printing unit 01. Placing the pipelines in the base area 09 of the printing unit 01 enables a short pipeline connection to this control device. Consumers of compressed air of this type, and which may be arranged symmetrically between the side frames 02, can be supplied with compressed air by the control device through pipelines of equal length. This central distribution ensures improved synchronization, for example, of the strokes of the operating cylinders that are actuated with the compressed air that is supplied using the control device.

The side frames 02 are preferably made of a metallic material, such as cast iron. The longitudinal crossbars 17, which border the base area 09 of the printing unit 01 on two parallel sides, preferably each have a projection 18, extending longitudinally relative to the pipelines 11; 12; 13; 14, on at least one side of the side frame 02 that extends parallel to the width "b" of the printing unit 01, with such a projection being located at least on one of an intake side or on an outlet side for the print substrate 24 that can be fed through this printing unit 01. Each such projection 18 is oriented longitudinally along the direction of transport of the print substrate 24 that can be fed through this printing unit 01. Each such projection 18 projects beyond a part of the side frames 02 that bounds the printing couple, for example. Each such projection 18 is preferably embodied as a cast component. A side frame 02 with a single projection 18 formed onto it thus has the shape of an "L" in a side elevation view. Preferably, however, at least one such projection 18 is formed on each of the two sides of the side frames 02 which extend parallel to the width "b" of the printing unit 01, so that there is a separate such projection 18 on both the intake side and the outlet side for the print substrate. As a result the relevant side frame 02 has the shape of an upside-down "T", again in a side elevation view. Preferably, both side frames 02 of the same module 01 are in the shape of this upside-down "T".

On an end surface of each one of the respective projections 18, or in other words, on the respective end surfaces that will be joined to similar end surfaces of another module of the printing press, at least one vertical fixed stop 19 is arranged. By use of these vertical fixed stops 19, for example, two modules, and particularly two printing units 01, which are to be arranged adjoining one another in a row, can be aligned relative to one another and can actually be joined with one another in an alignment extending in the direction of transport of the print substrate 24. Such an alignment can be accomplished during setup of the printing press at the location where the printing press will be used, particularly on the customer's premises, such as, for example, in a print shop. In addition to aligning printing units 01 to be arranged adjoining one another in a row, the respective fixed stop 19 can also be used to align a printing unit 01 having such a fixed stop 19 with another, adjoining module of this printing press, such as, for example, a reel changer, an infeed unit, a varnishing unit, a dryer, or a folder, in alignment in the direction of transport of the print substrate that can be fed through the printing unit 01. This alignment can be accomplished, for example, by butting these stops 19 against one another at a shared joint, such as, for example, directly in one contact surface, and thus without interconnection.

During setup of, for example, two printing units 01, which are to be arranged adjoining one another in a row, at least one of the fixed stops 19 on the two side frames 02 of the same printing unit 01 can also limit or can even prevent any offset between these two printing units 01 in a direction parallel to the width "b" of said printing unit 01, such as, transversely to the direction of transport of the print substrate 24 that can be fed through this printing unit 01. This can be accomplished, for example, by the provision of a corresponding configuration of the joining surface on the respective projection 18. In this case, the joining surface preferably has a surface section, for example, in the form of a lateral stop, which is capable of absorbing or of supporting forces exerted parallel to the width "b" of the module. In this manner, in addition to the alignment extending longitudinally along the direction of transport of the print substrate 24, an additional degree of freedom of the relevant module 01, namely oriented transversely to the direction of transport of the print substrate 24, is restricted during setup in the relevant setup plane 28, as seen in FIG. 3, so that the setup of this module in the print shop is simplified even further. The side frames 02 of the module need only to be aligned vertically in their respective set-up plane 28, to prevent tilting of the side frames 02, and thus to also prevent tilting of the entire module, relative to a horizontal line "L", as seen in FIG. 3, with such tilting being caused, for example, by irregularities in the setup plane 28. The lateral stop can be formed directly on, or can at least be attached to at least one of the two projections 18, which are formed on the same intake side or on the same outlet side for the print substrate 24 that can be fed through this printing unit 01.

In the preferred embodiment of the present invention, a plurality of the printing units 01 in the printing press, and preferably all of those printing units, each have a projection 18 as described above, preferably situated both on their respective intake side for the print substrate 24 and on their respective outlet side, each which projection is respectively embodied as a component of the relevant side frame 02. Each pair of side frames 02 belonging to the same printing unit 01 is mechanically machined, for example, at least around their periphery, by the manufacturer of this relevant printing unit 01 at the same tension, in other words, by machining both side frames 02 together in one interconnected unit. The projections 18, which are formed on these side frames 02, are also processed such that their dimensions will match one another. The end surfaces of these projections 18, which are machined on the same side of the relevant printing unit 01, then each form one of the two cooperating fixed stops 19, with which, for example, adjoining printing units 01 will be aligned relative to one another during their setup in the print shop. An alignment of adjoining printing units 01, in their respective setup plane 28, is thereby simplified. To form an alignment between adjoining printing units 01, it is necessary only to join their respective, properly dimensioned fixed stops 19 with one another along a butt joint, without any additional measurement being required. Because the joining surfaces of the respective fixed stops 19 on the two longitudinal crossbars 17 are produced by machining the two side frames 02 at the same tension in a machining tool, such as a milling machine, the fixed stops 19 of the two side frames 02 are optimally adapted to one another, in terms of their dimensions. Each of the side frames 02, together with its assigned longitudinal crossbar 17 and the at least one projection 18 formed on this longitudinal crossbar 17 of each such side frame 02, is preferably produced as a single piece, such as, for example, by casting methods.

Each of the two longitudinal crossbars 17 of the same printing unit 01 is installed in the setup plane 28 of this printing unit 01, for example, with preferably the inclusion of a plurality of shock absorbing elements 26, such as, for example four shock absorbing elements 26, such as so-called airlock shoes 26. The vibration of the relevant printing unit 01 is thereby damped, particularly during production runs, against its setup plane 28, which setup plane 28 may be, for example, a base plate 28 of cast concrete, and on which base plate 28 this printing unit 01 is set up in a print shop. Once a plurality of printing units 01 belonging to the same printing press have been set up in alignment with one another, their respective pipelines 11; 12; 13; 14 can be coupled to one another, for example, through the use of quick-release couplings 33 or through the use of other suitable connecting elements 33, as seen in FIG. 4, and thereby can be connected with one another to form a continuous system for the respective supply of media. The pipelines 11; 12; 13; 14 of at least each of the same type of module of the printing press are preferably configured of equal length, namely particularly having the same length as the longitudinal crossbars 17. The result is that these modules of the printing press preferably have their connectors, so that each of which modules can preferably be coupled, on both their respective intake side for the print substrate 24 and their respective outlet side, with the respective couplings lying adjacent to one another, side by side, and ending in a coupling plane 32 that extends transversely to the direction of transport of the print substrate 24, all as seen in FIG. 1, FIG. 2 and FIG. 4.

The shock absorbing elements 26, which may be arranged in or on the longitudinal crossbars 17, or other similar positioning elements, such as, for example hydraulic pistons, which may be arranged in the respective longitudinal crossbars 17 or at least may be attachable thereto, and further if they are embodied as at least height-adjustable, and preferably are height-adjustable individually and independently of one another, can also be used, for example, for leveling the relevant module 01. Such a leveling of the respective module 01 is indicated in FIG. 3 by a vertical double arrow. In an alternative embodiment, which is not specifically depicted, and in which the module to be aligned vertically during its setup in its respective setup plane 28, such an alignment is aligned using a tool that is separate from this module and that is to be brought up to the module 01. This can be done, for example, by using a hydraulic piston to be placed against the module, thereby eliminating any tilting that may have existed, for example. This tool can be placed against the relevant side frame 02, particularly on at least one of the longitudinal crossbars 17 of the module, and can be brought up to this module of the invention relatively easily. It can be moved, without impediment, as it is unnecessary to remove any attachments, such as platforms, from the relevant module before executing the leveling. The free accessibility to the respective longitudinal crossbars 17 of the module, which free accessibility results, particularly, from the arrangement of the pipelines 11; 12; 13; 14 in the base area 09 of this module, also facilitates re-leveling of this module, such as, for example, following an occurrence of severe shaking at the location of use of the printing press, which might be required, for example, after an earthquake.

A cable conduit 21 extends, preferably longitudinally, along the longitudinal crossbar 17 on whose side frame 02 the electrical switching cabinet 07 belonging to the printing unit 01 is arranged, as seen in FIG. 2. This cable conduit 21 is positioned outside of the base area 09 of this printing unit 01. The cable conduit 21 is usable for conducting at least one electric power cable, and/or a contact rail 22 for supplying the printing unit 01 with electric power is provided. The cable conduit 21 is preferably mounted directly on this longitudinal crossbar 17, and particularly without ground contact, as seen in FIG. 2. The cable conduit 21 and/or the contact rail 22 is preferably attached to the longitudinal crossbar 17 at the manufacturing plant by the manufacturer of this printing unit 01. The respective cable conduits 21 and/or contact rails 22 of modules, which are arranged adjoining one another in a row, can be joined to form a continuous cable conduit 21 in the printing press and/or a continuous contact rail 22 in the printing press. To avoid ground contact, the cable conduit 21 and/or the contact rail 22 are arranged vertically spaced from the setup plane 28, above a horizontal line L, which is shown as a dashed line in FIG. 3. The distance "a" between the horizontal line L and the setup plane 28 is between 5 mm and 300 mm, for example, and particularly is between 150 mm and 200 mm. In this manner, electric cables and/or the contact rail 22 are at least largely prevented from coming into contact with moisture on the floor, and particularly are prevented from coming into contact with a possible puddle. If a material web 24 will not be fed through the press nip of the printing couple 01, and is instead to be fed along the base area 09 of the module, for example, the web is also fed above the horizontal line L. As is shown in FIG. 3, multiple deflecting rollers 27 are also provided in the module and are usable for guiding the web 24. As alternatives, FIG. 3 also shows a first web path through the press nip of the printing couple and another, second web path in the base area 09 of the module. The first web path is shown by a solid line and the second web path, that runs through the base area 09, is indicated by a dashed line.

The cables which conduct electric power and the pipelines 11; 12; 13; 14 which conduct a liquid or gaseous medium are separated from one another by the longitudinal crossbar 17, for safety reasons. The structure of the printing unit 01 or module is also further simplified by assigning only a single electrical switchgear cabinet 07 to house all the necessary control and/or regulating systems to this printing unit 01. This single switchgear cabinet 07 is installed directly on one of the side frames 02 of the printing module 01 by the manufacturer of this printing unit 01. Most, if not all, of the electrical cable connections which may be necessary for the operation of this printing unit 01 can be preassembled and can be connected to the electrical switchgear cabinet 07 during manufacture of the printing unit 01 or module. An oil pump and/or a heat exchanger can also be pre-mounted in or on one of the side frames 02 of this printing unit 01, for example, by the manufacturer. This represents a space-saving configuration for units of this type. The oil pump and/or the heat exchanger are especially connected to at least one of the pipelines 11; 12; 13; 14 which are arranged in the base area 09 of the module 01.

The above-described measures result in the embodiment of the printing unit in accordance with the present invention as a compactly structured module, and particularly as a compact printing unit 01. As was discussed above, several of these modules can be easily assembled on-site on the customer's premises to form a printing press.

FIG. 4 shows a plan view of the pipeline connection of, for example, five printing unit modules 01, all of which are arranged adjoining one another in a row in the direction of transport of the print substrate 24, and belonging to the same printing press. Each of these adjoining modules 01 is embodied, for example, as a printing unit 01 as was previously described in reference to FIG. 1 through FIG. 3. The modules 01, the contours of the respective side frames 02 of which are indicated only by dashed lines in FIG. 4, can be embodied as being essentially identical in structure, for example, and can each be of equal length "l", with that length "l" extending in the direction of transport of the print substrate 24, for example. The pipelines 11; 12; 13; 14 extend parallel to one another, and all continuously through all of the aligned modules 01 of this printing press, each in the base area 09 of one of the modules, and between their longitudinal crossbars 17, as depicted in FIG. 1 and FIG. 2, which longitudinal crossbars 17 are situated opposite to one another in pairs and which are indicated only by dashed lines in FIG. 4. At both the intake side of the print substrate 24 and also at the outlet side of the respective module, one or more mounting brackets 29, each extending over the inside width "w" of the respective module, are preferably provided, and with which mounting brackets 29 the pipelines 11; 12; 13; 14 are fixed in their respective positions.

Each of the individual pipelines 11; 12; 13; 14 involves, for example, at least one supply line and/or at least one return line for transporting a coolant, such as water or oil. This coolant is used, for example, for cooling a heat exchanger which may be located in an electrical switchgear cabinet 07 belonging to the respective module, or is used for controlling the temperature of at least one roller of the at least one inking unit 04 in the relevant module embodied as a printing unit 01. The heat exchanger is functionally connected, for example, to a drive controller, or directly to an electric motor 06, such as the motors 06 depicted in FIG. 1 and FIG. 2. Preferably, at least two coolant circuits are provided, which two coolant circuits are separate from one another, and whose temperature profiles can be controlled independently of one another. Also provided are pipelines 13, for example, which are usable for supplying compressed air to the at least one printing couple in this printing unit 01. If applicable, pipelines 14, for example, are also provided for use in removing a dampening agent that may be used in the printing couple. At least one of the pipelines 11; 12; 13; 14 that pass through a plurality of modules has a branch 31, or optionally a shut-off valve 31, for example, in a plurality of the sections of the printing press, which are defined by the length "l" of the respective module. One such branch 31 or shut-off valve is preferably provided in each of these sections.

The respective pipelines 11; 12; 13; 14 of two adjoining modules, which are configured based upon the length "l" of the respective module, each end in a coupling plane 32 that is shared by these two modules, and which coupling plane 32 extends transversely to the direction of transport of the print substrate 24. The respective pipelines 11; 12; 13; 14 of different modules can be coupled in the respective coupling plane 32, for example, each by the provision and utilization of a coupling 33, and particularly through the use of a quick-release coupling 33 or some other type of connecting element 33. The respective projections 18 of adjoining modules are joined to one another within this coupling plane 32, which is shared by the two modules, at a butt joint, preferably by using their respective fixed stops 19.

Figure 5:
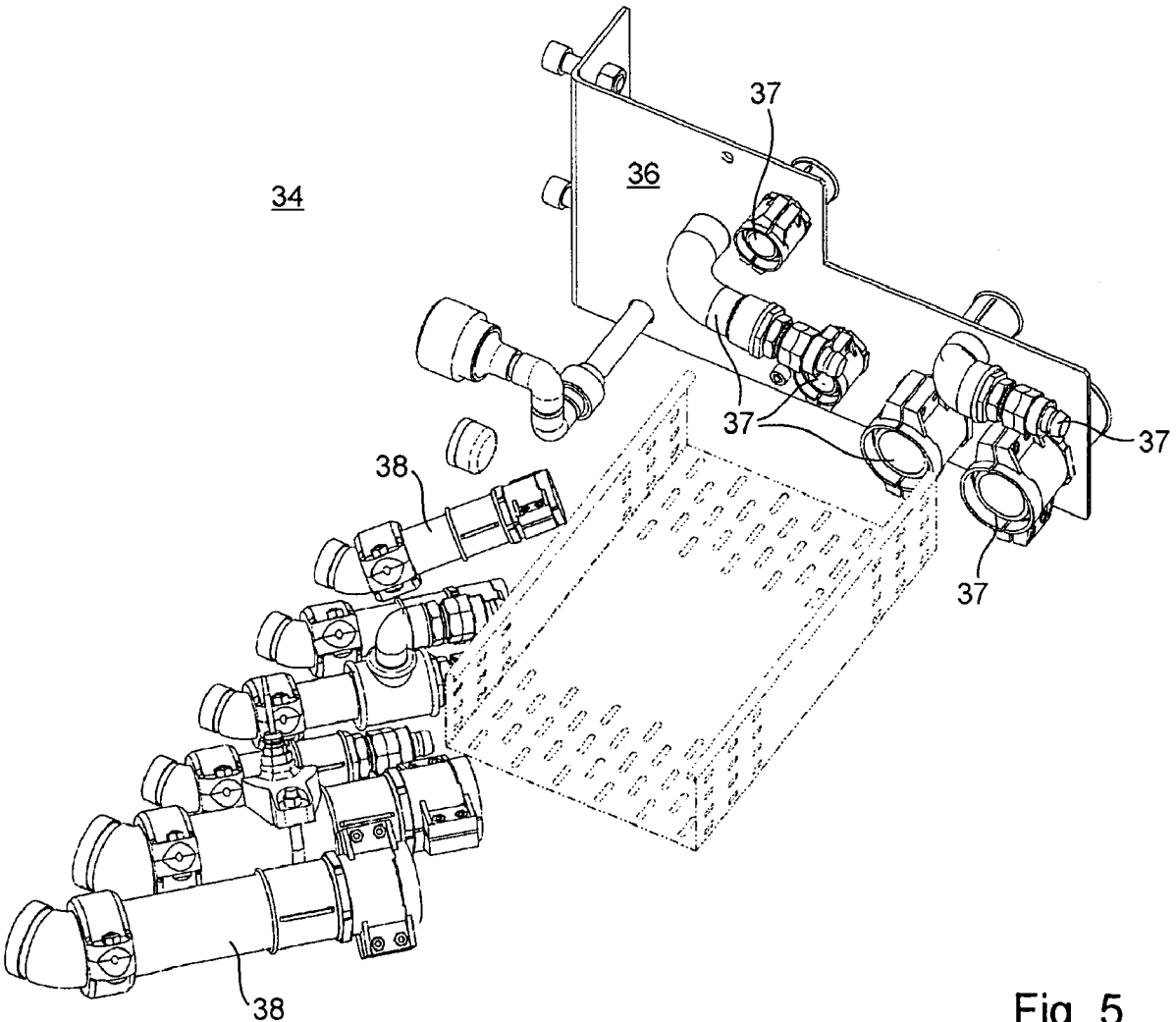
FIG. 5 a perspective view of an adapter for use in the bundled connection of a supply of media to at least the printing units of the printing press according to FIG. 4 to a supply network.

An adaptor 34 is advantageously arranged at least at one end of the printing units 01 arranged in a row, or is arranged at least at one end of the entire printing press, which printing press is comprised of a plurality of printing units or modules 01 arranged in a row. The adapter 34 is advantageously such that multiple pipelines, and preferably all of the pipelines 11; 12; 13; 14 of the relevant modules are held together. A shared adapter 34 is preferably provided, at least for the modules of reel changer, infeed unit, and the printing units 01 which are arranged downstream. A separate adapter 34 can be provided for the folder module. The adapter 34 forms a compactly structured connection point for the pipelines 11; 12; 13; 14. The media supply for at least the contiguously pipe-connected modules, and preferably the entire printing press, can be connected, as a bundle, to an in-house and/or public supply network, for example, through the use of such an adaptor 34. The adapter 34 is arranged, for example, on a longitudinal crossbar 17 of the printing unit module 01 that is arranged at the end of the printing press and can be attached to the longitudinal crossbar 17, for example, by a screw connection. FIG. 5 shows, by way of example, a perspective view of an embodiment of this adapter 34 and consisting essentially of a bracket 36, in which multiple, and preferably all of the pipelines 11; 12; 13; 14 that pass through the modules are held together. The bracket 36 preferably has, for example, a standard or at least has a standardized connecting port 37 for each of the pipelines 11; 12; 13; 14. Lines for the, for example, in-house and/or public supply network for the media to be conducted through the pipelines 11; 12; 13; 14 can be easily connected to these connecting ports 37 during setup of the printing press. The connecting ports 37 of the adapter 34 are preferably configured in accordance with the valid standards for lines for the, for example, in-house and/or public supply network, at the setup location of the printing press. The adapter 34 is thus optionally configured, or at least can be so configured, regardless of the embodiment of the pipelines 11; 12; 13; 14 that are positioned inside the respective module and their connecting elements 33 and/or branches 31. With this optional configuration of at least the connecting ports 37 of the adapter 34, a printing press which may be intended for worldwide distribution can be easily and cost-effectively adapted to various different country-specific standards for the lines of, for example, in-house and/or public supply networks.

Figure 6:
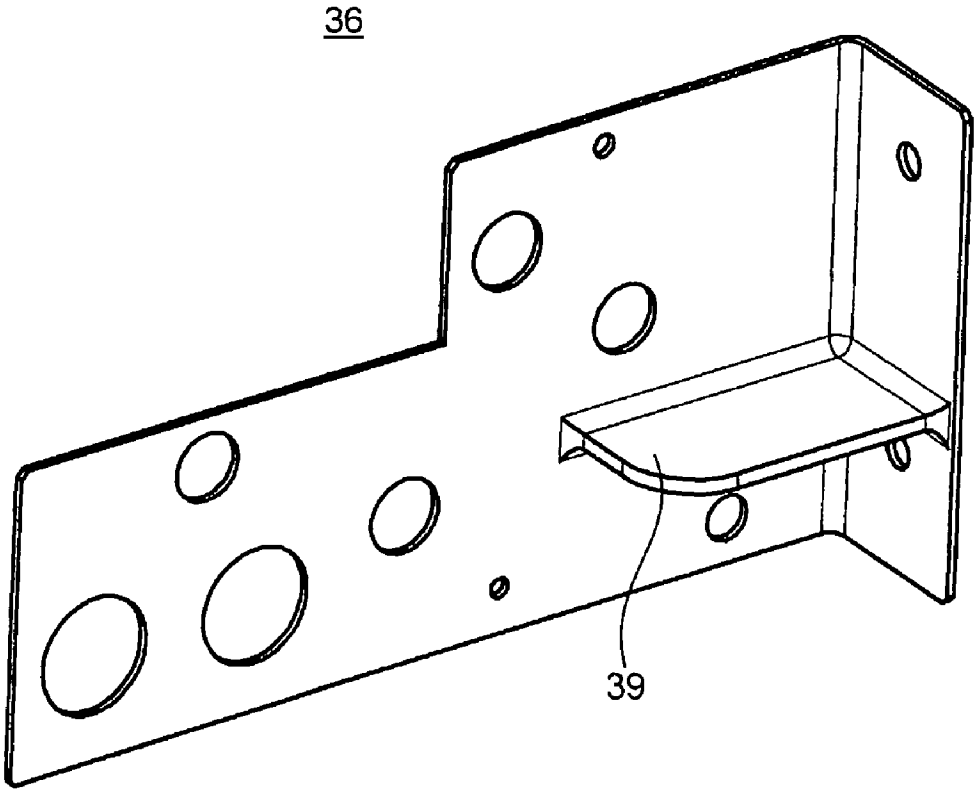
FIG. 6 a perspective view of a mounting bracket for the adapter depicted in FIG. 5.

Each of the pipelines 11; 12; 13; 14 is connected, or at least can be connected, to the connecting ports 37 which are arranged in the, for example, plate-type bracket 36, such as, for example, by the use of elbow connectors 38 and/or, for example, by the use of flexible hoses, which are not specifically shown. FIG. 6 shows, by way of example, a perspective view of the embodiment of the bracket 36 of the adapter 34 depicted generally in FIG. 5. This bracket 36 is embodied, for example, as an angled plate, which may be reinforced, for example, by a rib 39. This angled plate is equipped with openings, and particularly is provided with bored holes, that can be configured and positioned as needed, for use in attaching the connecting ports 37 to the bracket 36. An adapter 34 of this type, for use in bundling the connections for the pipelines 11; 12; 13; 14, can be cost-effectively produced and facilitates start-up of the printing press. The adapter 34 can preferably optionally be arranged on one of the longitudinal sides of the printing press, or with its connecting ports 37 oriented toward the end surface of this printing press, thereby allowing for flexible adjustment to the circumstances at the setup location for the printing press.

As was particularly described in reference to FIG. 4, and in accordance with the present invention, a printing press having a plurality of modules 01 arranged adjoining one another in a row in the direction of transport of a print substrate 24 that can be fed through said printing press is created. Each one of this plurality of printing unit modules 01 has a pair of side frames 02 which are situated opposite one another. Each of these side frames 02 has a longitudinal crossbar 17 which is oriented in the direction of transport of the print substrate 24 that can be fed through said the resultant printing press. The two longitudinal crossbars 17 of a pair of opposite side frames 02 delimit or define a base area 09 of this printing press on two parallel sides. The respective longitudinal crossbars 17 of a plurality of similar printing unit modules, which are arranged in a row, are preferably aligned with one another in a row, and form a continuous base area 09 in the printing press. A plurality of pipelines 11; 12; 13; 14 which serve to supply media to the modules of this printing press are arranged in this resultant continuous base area 09 of the printing press. The medium which is conducted through these pipelines 11; 12; 13; 14 is either liquid or gaseous. At least one of the pipelines 11; 12; 13; 14 is connected to at least one consumer of one of the media, which consumer of the media is located in one of the modules of this printing press and is to be supplied with the respective medium, or is connected to at least one source that supplies the respective medium.

While a preferred embodiment of a printing unit of a printing press, a method of use of such a printing unit, and a printing press with a plurality of printing unit modules, all in accordance with the present invention, have been completely and accurately described hereinabove, it will be apparent to one of skill in the art that various changes in, for example, the specific structures of the various cylinders, the types of inking and dampening units, the sources of supply of the respective media, and the like, could be made without departing from the true spirit and scope of the present invention which is accordingly to be limited only by the appended claims.

What is claimed is:

1. Printing unit of a printing press with a pair of side frames (02) arranged opposite one another, between which at least one printing couple with a plurality of printing couple cylinders (03) and at least one inking unit (04) is arranged, wherein each of the two side frames (02) has a longitudinal crossbar (17) oriented in the direction of transport of a print substrate (24) that can be fed through the printing unit (01), wherein the two longitudinal crossbars (17) delimit a base area (09) of the printing unit (01) on two parallel sides, characterized in that a plurality of pipelines (11; 12; 13; 14) are arranged in the base area (09) between the two longitudinal crossbars (17) of this printing unit (01), which serve to supply media to this printing unit (01), wherein the medium conducted through these pipelines (11; 12; 13; 14) is liquid or gaseous, wherein at least one of the pipelines (11; 12; 13; 14) is connected to at least one consumer which is located in this printing unit (01) and is to be supplied with the respective medium, or to at least one source which supplies the respective medium.

2. Printing unit of claim 1, characterized in that the pipelines (11; 12; 13; 14) correspond to a length (l) of this printing unit (01), oriented in the direction of transport of the print substrate (24).

3. Printing unit of claim 1, characterized in that the pipelines (11; 12; 13; 14) extend parallel to one another in the direction of transport of the print substrate (24).

4. Printing unit of claim 1, characterized in that each of the pipelines (11; 12; 13; 14) is equipped with a coupling (33) at each of its respective ends.

5. Printing unit of claim 1, characterized in that at least one of the pipelines (11; 12; 13; 14) is connected via a branch (31) to at least one consumer located in this printing unit (01) or to at least one source.

6. Printing unit of claim 1, characterized in that an oil pump and/or a heat exchanger is arranged in or on one of the side frames (02), wherein the oil pump and/or the heat exchanger are each connected to at least one of the pipelines (11; 12; 13; 14).

7. Printing unit of claim 1, characterized in that a cable conduit (21) and/or a contact rail (22) for supplying this printing unit (01) with electric power are arranged outside of the base area (09) of this printing unit (01), directly on at least one of the longitudinal crossbars (17).

8. Printing unit of claim 1, characterized in that between the pair of side frames (02) arranged opposite one another, at least two printing couples are provided, wherein these printing couples are equipped with their own separately operable drives (06).

9. Method of using a printing unit (01) according to claim 1, characterized in that the pipelines (11; 12; 13; 14) of the printing unit (01) are preassembled and fully coupled to their respective consumers or sources arranged in the printing unit (01), before the printing unit (01) is transported to the location where the printing press will be used.

10. Printing press with a plurality of modules arranged in a row in the direction of transport of a print substrate (24) that can be fed through this printing press, wherein a plurality of these modules each have a pair of side frames (02) arranged opposite one another, wherein each of these side frames (02) has a longitudinal crossbar (17) oriented in the direction of transport of the print substrate (24) that can be fed through this printing press, wherein the two longitudinal crossbars (17) of a pair of opposite side frames (02) delimit a base area (09) of this printing press on two parallel sides, characterized in that the respective longitudinal crossbars (17) of modules arranged in a row are arranged in a row, and form a continuous base area (09) in the printing press, wherein a plurality of pipelines (11; 12; 13; 14) that serve to supply media to the modules of this printing press are arranged in the continuous base area (09) of the printing press, wherein the medium conducted through these pipelines (11; 12; 13; 14) is liquid or gaseous, wherein at least one of the pipelines (11; 12; 13; 14) is connected to at least one consumer which is located in one of the modules of this printing press and is to be supplied with the respective medium, or to at least one source that supplies the respective medium.

11. Printing press of claim 10, characterized in that at least one of the pipelines (11; 12; 13; 14) extends through the entire length (l) of at least one of the modules, oriented in the direction of transport of the print substrate (24) that can be fed through this printing press, and is coupled to a pipeline (11; 12; 13; 14) arranged in the adjoining module, in a coupling plane (32) which extends between two adjoining modules, transversely to the direction of transport of the print substrate (24) that can be fed through this printing press.

12. Printing press of claim 10, characterized in that an adapter (34) in which multiple pipelines (11; 12; 13; 14) are held together is arranged on at least one end of a plurality of modules of this printing press arranged in a row.

13. Printing press of claim 10, characterized in that the adapter (34) is optionally arranged on one of the longitudinal crossbars (17) of the module which is arranged at the end of the plurality of modules of this printing press, arranged in a row.

14. Printing press of claim 10, characterized in that at least one of its modules is embodied as a printing unit (01) or as a reel changer or as an infeed unit or as a varnishing unit or as a dryer or as a folder.

15. Printing press of claim 10, characterized in that its modules are arranged within a shared setup plane (28).

* * * * *